US007845493B2

(12) United States Patent
Cho

(10) Patent No.: US 7,845,493 B2
(45) Date of Patent: Dec. 7, 2010

(54) COMPRESSOR PACKING MEMBER

(75) Inventor: Phil Ho Cho, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/164,274

(22) Filed: Jun. 30, 2008

(65) Prior Publication Data

US 2008/0264305 A1 Oct. 30, 2008

Related U.S. Application Data

(63) Continuation of application No. 10/793,754, filed on Mar. 8, 2004, now Pat. No. 7,426,995.

(30) Foreign Application Priority Data

Dec. 5, 2003 (KR) ..... 10-2003-88240
Dec. 5, 2003 (KR) ..... 10-2003-88241

(51) Int. Cl.
*B65D 19/00* (2006.01)
*B65D 85/68* (2006.01)

(52) U.S. Cl. ..... 206/319; 206/386

(58) Field of Classification Search ..... 206/319, 206/386, 595, 599, 509, 503, 521, 562, 523, 206/588, 589; 108/901, 902
See application file for complete search history.

(56) References Cited

U.S. PATENT DOCUMENTS 3,495,705 A 2/1970 Limbacher
3,717,245 A 2/1973 Brander et al.
3,732,976 A 5/1973 Bessett et al.
3,987,829 A 10/1976 Leone
4,580,680 A * 4/1986 Wind ..... 206/386
D289,938 S 5/1987 Warwick
4,875,580 A * 10/1989 Stringer et al. ..... 206/319
4,892,196 A * 1/1990 Okajima ..... 206/523
4,896,774 A 1/1990 Hammett et al.

(Continued)

FOREIGN PATENT DOCUMENTS

JP 6-156489 6/1994
KR 20-1989-0022914 12/1989
KR 10-2001-0066577 7/2001
KR 2003-0080742 10/2003

OTHER PUBLICATIONS

Korean Office Action dated Jun. 24, 2009.
Korean Notice of Allowance dated Oct. 16, 2009.

*Primary Examiner*—Jila M Mohandesi
*Assistant Examiner*—Steven A. Reynolds
(74) *Attorney, Agent, or Firm*—Ked & Associates LLP

(57) ABSTRACT

Compressor packing member which can pack compressors in many tiers is disclosed. The compressor packing members includes a pallet having first pins projected from an upper surface for holding mounting plates of compressors, and supporting surfaces formed in the upper surface for supporting lower parts of the compressors, and a pad inserted between tiers of compressors stacked on the pallet in multiple tiers for protecting the compressors. The pad includes platforms each arranged at corners of each loading lot for supporting corners of the mounting plate of the compressor, reinforcing ridges each projected between adjacent platforms for preventing deformation of the platforms, thereby stacking, and packing multiple tiers of a plurality of compressors.

5 Claims, 6 Drawing Sheets

U.S. PATENT DOCUMENTS

| | | | |
|---|---|---|---|
| 5,011,011 | A | 4/1991 | Kidd |
| D361,431 | S | 8/1995 | Koefelda |
| 5,497,708 | A | 3/1996 | Jeruzal |
| 5,501,352 | A | 3/1996 | Apps |
| 5,660,279 | A | 8/1997 | Apps et al. |
| 6,264,037 | B1 | 7/2001 | Maston et al. |
| 6,305,767 | B1 | 10/2001 | Filipek et al. |
| 6,405,873 | B2 | 6/2002 | Koike |
| 2003/0106833 | A1 | 6/2003 | Chen et al. |

* cited by examiner

COMPRESSOR PACKING MEMBER

This application is a Continuation of U.S. patent application Ser. No. 10/793,754, filed Mar. 8, 2004, now U.S. Pat. No. 7,426,995 which claims the benefit of the Korean Application Nos. P2003-88240, and P2003-88241, both filed on Dec. 5, 2003. All of these documents are hereby incorporated by reference.

BACKGROUND OF THE INVENTION

1. Field of the Invention

The present invention relates to packing materials, and more particularly, to a compressor packing member of an improved structure which can pack compressors in many tiers.

2. Background of the Related Art

In general, for mass transportation of products, such as compressors, a plurality of products are stacked to form a packed body, which is carried with equipment such as a fork-lift. For this, the plurality of products are stacked on a pallet in many tiers for easy carry with the fork-lift, or the like, with a pad provided between adjacent tiers.

FIGS. 1 and 2 illustrate examples of the pallets and the pads respectively, referring to which the pallets and the pads will be described, in more detail. Before starting description of the pallet, and the pad, an outside structure of the compressor will be described, briefly.

Referring to FIG. 1, the compressor 10 is provided with an upper case 11 and a lower case 12 assembled together, to form an enclosed space having various parts of the compressor 10 arranged therein.

The lower case 12 has a mounting plate 13 in a lower part thereof having at least one hole 14 for passing a fastening member, such as a bolt (not shown). Therefore, the compressor 10 can be fastened to a place intended to mount by using the fastening member and the mounting plate 13.

In the meantime, the lower case 12 has nipples 15 projected outward therefrom for connection of pipes (not shown) for flow of a working fluid, such as refrigerant. Accordingly, the working fluid flowing in the pipes is introduced into the compressor 10 through one of the nipples 15, compressed in the compressor 10, and discharged out of the compressor.

The plurality of the compressors 10 are stacked on the pallet 10 aligned with each other, wherein the pallet 10 will be described.

The pallet 10 is in a lowest part of the packed body, and supports the compressors 10 stacked at the first time. The pallet 10 is provided with panels 21 and blocks 22 of wood.

Referring to FIG. 1, the panel 21 is long, and a plurality of the panels 21 are put together into a form of a grating. The grating form of assemblies of the panels 21 are arranged in up and down direction, and the blocks 22 are fixed between the assemblies.

This structure enables the forklift to carry the pallet 10 having the compressor 10 stacked thereon as the fork can be inserted between the assemblies, easily.

In the meantime, there are a plurality of pins 23 on an upper surface of an upper assembly. Therefore, when the pins 23 are inserted in the holes 14 in the mounting plate 13, the compressor 10 can be loaded on the pallet, securely.

Referring to FIG. 2, a pad 30 is placed on the compressors 10 on the pallet 10, and a plurality of compressors 10 are placed on the pad 30 again, wherein the pad 30 will be described in more detail.

The pad 30 is rectangular substantially when seen from above. The pad 30 has a plurality of loading lots 31 each for placing one compressor therein. The loading lot 31 is a hollow in an upper surface of the pad 30, a plurality of which are formed in tows and columns in the pad 30.

The loading lot 31 has supporting surfaces 34 for supporting the mounting plate 13 of the compressor 10, projected to a height from a bottom surface of the loading lot 31. Since the supporting surface 34 has the pin 35 projected therefrom, once the pin 35 is inserted in the hole 14 of the mounting plate 13, the compressor 10 can be loaded in the loading lot.

The loading lot 31 has dome 32 for preventing a top of an underlying compressor 10 from coming into contact with the pad 30. The dome 32 has a projection 33 from a central part thereof for preventing a part possibly provided to top of the compressor 10 from coming into contact with the dome 32.

It is preferable that the top of the dome 32 is lower than the supporting surface 34, for preventing the top of the dome 32 from coming into contact with an underside of an overlying compressor 10 loaded in the loading lot 31.

In the meantime, there are a first partition wall 36 and a second partitions walls 37*a*, and 37*b* between the rows and columns of loading lots 31 on the pad 30 for compartmentalization of the loading lots 31. The first partition wall 36 is formed such that the loading lots 31 form columns, and the second partition walls are arranged such that the second partition walls 37*a* and 37*b* form rows.

The compressors 10 are loaded in the loading lots 31 of the pad 30, respectively. And, the pad 30 and the compressors 10 are stacked again in succession on the compressor 10 loaded on the pad 10. Lastly, the pad 30 or the Styrofoam or the like is placed on top of the compressor 10 loaded on an uppermost tier.

The stack of pallet 10, the compressors 10, and the pads 30 become one unitized packed body as the stack of pallet 10, the compressors 10, and the pads 30 are bound, or packed altogether. Since the packed body can be carried with transportation equipment, such as a forklift easily, mass transportation of the compressors 10 is possible.

However, the foregoing related art pallet and pad have the following problems.

First, in the pallet, the pins are formed separate from the panel, and attached thereto. Therefore, it is liable that the pin can be detached by an external force easily, to cause the compressor to hit adjacent compressor, to damage the compressor during transportation.

Second, referring to FIG. 3, the central part of the lower case of the compressor is projected downward lower than a bottom of the mounting plate. Therefore, when the compressor is placed on the pallet, the central part of the lower case comes to a space with no the panels. Due to this, load of the compressor is concentrated on the space with no panels, applying a bending moment on the mounting plate. Consequently, the pin is liable to damage by the bending moment.

Third, the pallet, formed of wood, is liable to damage, or rotten as time goes by, resulting in recycling of pallet impossible.

Fourth, once the compressors are loaded in the loading lots, opposite sides of the pad droop downward centered on the first partition wall and the second partition walls (see arrows in FIG. 2), when edges of the pad move down more than a central part.

The drooping of the pads thus impedes binding of the stack of multiple tiers of compressors after stacking the compressors by using the pallet and the pads, or stacking of the packed bodies in many tiers for storage. Because the drooping of the pad leads middle part of the packed body higher than edge part of the packed body, if the packed bodies are stacked in many tiers, it is liable that an upper packed body slips down.

SUMMARY OF THE INVENTION

An object of the present invention lies on preventing easy damage of a pin by increasing strength of the pallet, and spread a load of the compressor.

Other object of the present invention lies on recycling of a pallet.

Another object of the present invention lies on reinforcement of a pad inserted between adjacent tiers of compressors stacked in multiple tiers.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the pallet for packing compressors including an upper plate having pins projected from an upper surface thereof for holding mounting plates of the compressor, and supporting surfaces for supporting a lower part of the compressor, a lower plate arranged under, and spaced from, the upper plate, and a connection part for supporting the upper and lower plates, with a space maintained between the upper and lower plates.

The upper plate is formed as one unit.

The supporting surfaces are arranged in a plurality of rows and columns on an upper part of the upper plate.

The supporting surface includes a recess in the upper surface of the upper plate, and the pin is projected from the supporting surface.

The supporting surface includes an upper surface formed to fit to the mounting plates attached to the lower part of the compressor, and an underside surface of a case of the compressor.

The connection part includes at least one part formed as one unit with at least one of the upper plate and the lower plate.

The connection part includes an upper part extended from the upper plate, and a lower part extended from the lower plate, and bonded to the lower part.

The supporting surface includes at least two pins provided thereto.

The upper plate is formed of plastic.

In other aspect of the present invention, there is provided a pad for packing compressors including platforms arranged in rows and columns each for supporting corners of mounting plates of the compressor, loading lots recessed among four platforms for placing the compressor thereon, and reinforcing ridges each projected between platforms adjacent in a column direction for preventing row direction sides of the platform from drooping.

The compressor is mounted on the loading lot such that corners of the mounting plates are respectively supported on four platforms arranged adjacent to one another.

The platform includes supporting surfaces each projected to a height from a bottom surface of the loading lot for supporting the corner of the mounting plate, pins each projected from the supporting surface for inserting in a hole of the mounting plate.

The supporting surfaces and the pins are provided to the corners of the platform, respectively.

The platform includes a rib in a form of a cross projected from an upper surface for reinforcing strength.

The platform includes a reinforcing groove extended along the row or column direction in an upper surface of the rib for reinforcing strength.

The platform includes a reinforcing groove in a central part of an upper surface extended in the row or column direction for reinforcing strength.

The reinforcing ridge is extended in the row direction.

The reinforcing ridge has one side connected to one side of the platform with a concave surface.

The pad further includes partition walls each projected to connect a space between the platforms adjacent in the row direction, and separating the loading lots adjacent in the column direction.

The partition wall has opposite ends connected to the platforms respectively formed higher than a central part.

The pad further includes a dome projected from the loading lot for preventing a top part of an underlying compressor from coining into contact therewith.

The pad further includes a circumference provided for connecting an outermost platform and the loading lot has a height the same with an upper surface of the platform.

The platforms, the loading lots, and the reinforcing ridges are formed as one unit.

The pad is formed of a plastic or corrugated board.

In another aspect of the present invention, there is provided compressor packing members including a pallet having first pins projected from an upper surface for holding mounting plates of compressors, and first supporting surfaces formed in the upper surface for supporting lower parts of the compressors, and a pad inserted between tiers of compressors stacked on the pallet in multiple tiers for protecting the compressors, including platforms each arranged at corners of each loading lot for supporting corners of the mounting plate of the compressor, reinforcing ridges each projected between adjacent platforms for preventing deformation of the platforms.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Figure 1:
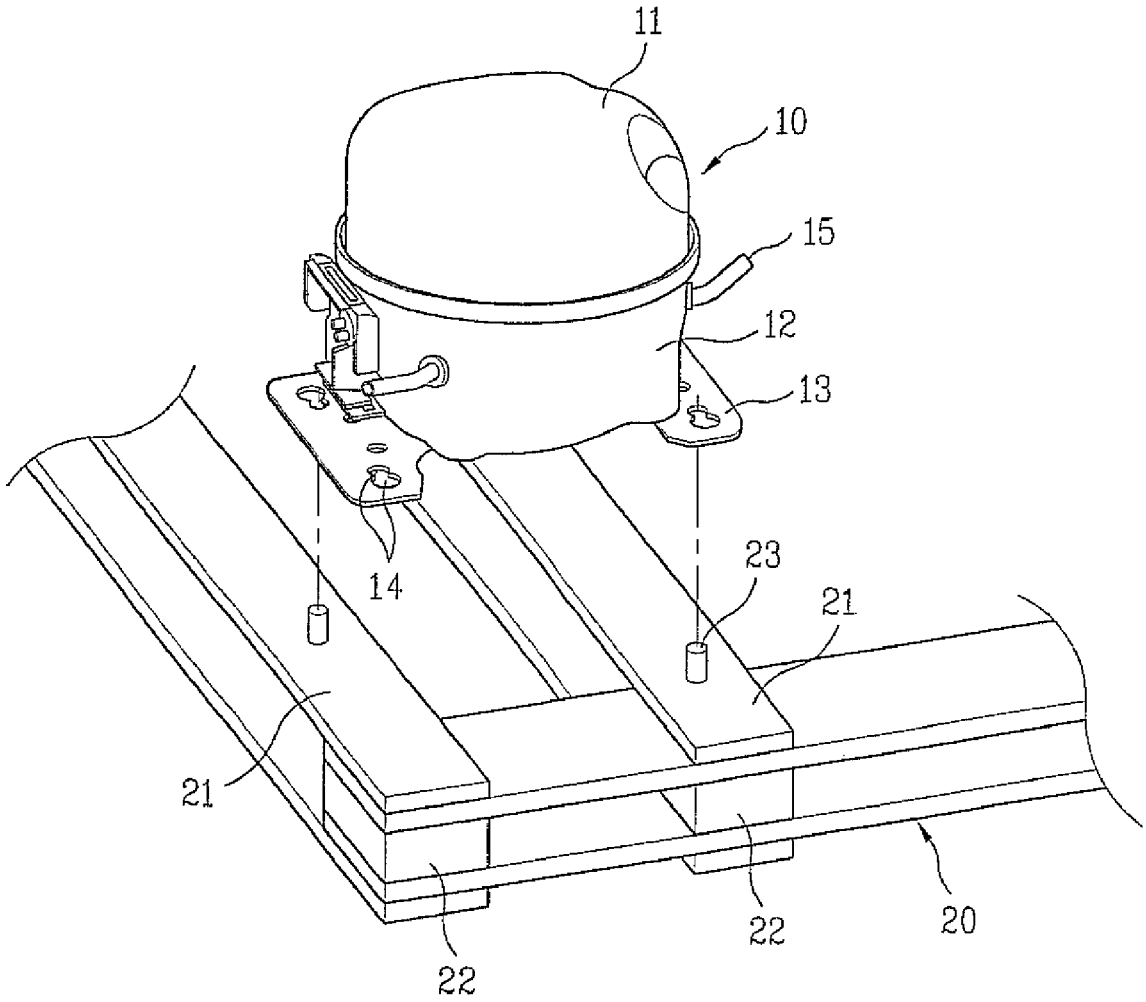
FIG. 1 Prior Art
FIG. 1 illustrates a partial perspective view of loading a compressor on a related art pallet.
Figure 2:
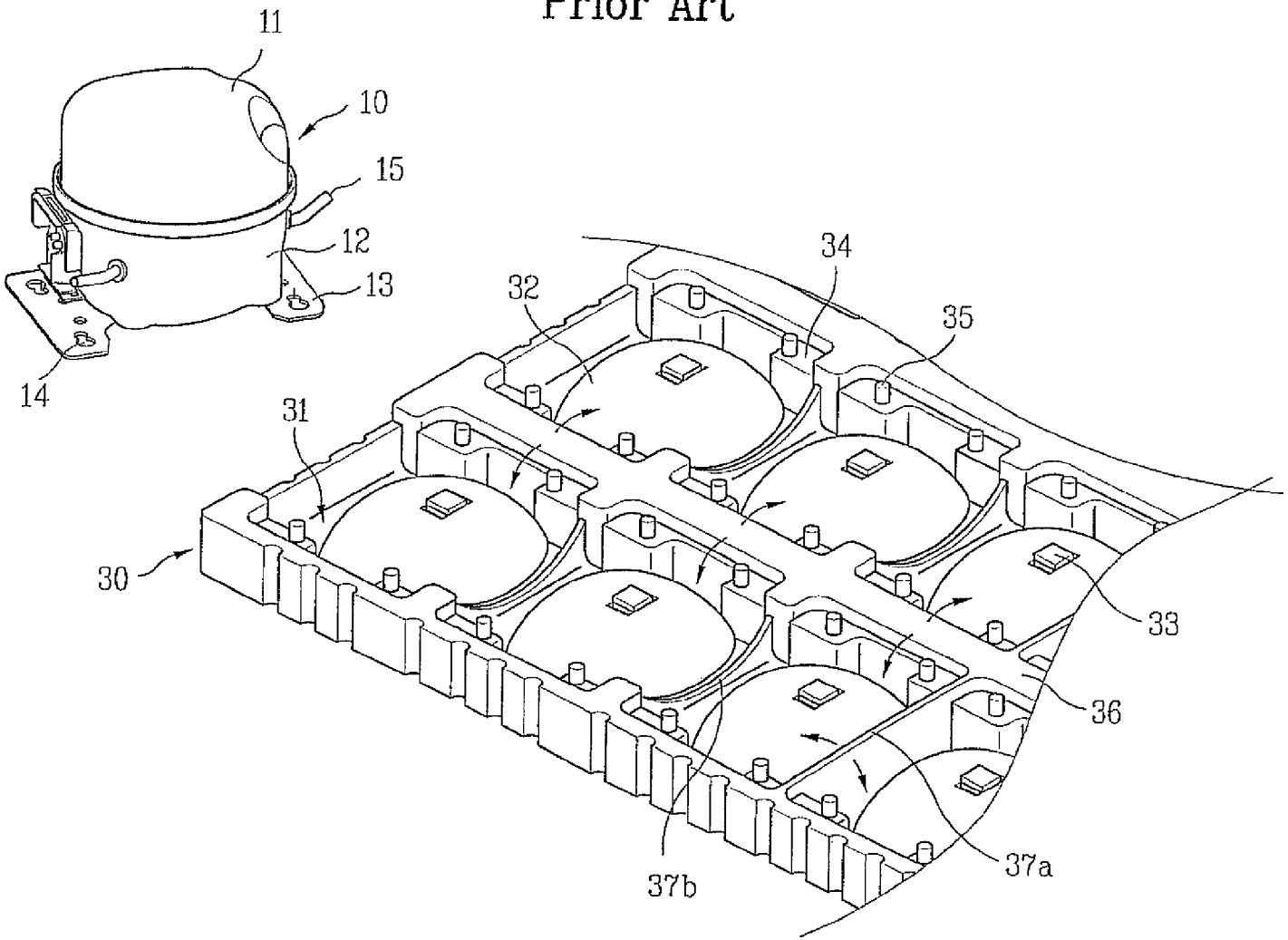
FIG. 2 Prior Art
FIG. 2 illustrates a partial perspective view of loading compressors on a related art pad.
Figure 3:
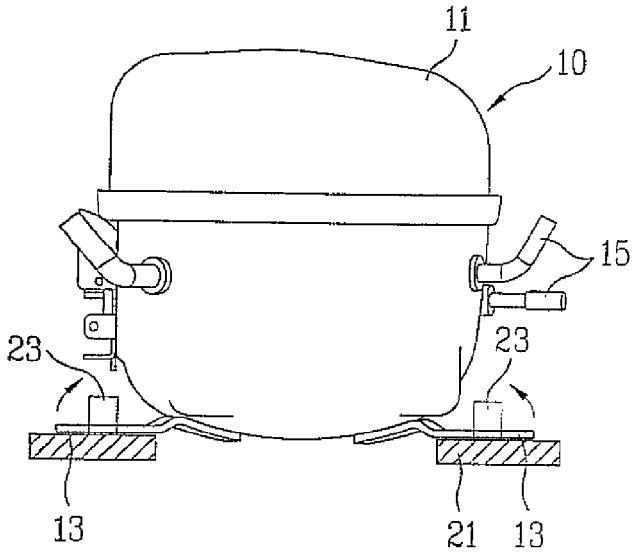
FIG. 3 Prior Art
FIG. 3 illustrates a partial section showing that a compressor is fixed to the pallet in FIG. 1.

Reference will now be made in detail to the preferred embodiments of the present invention, examples of which are illustrated in the accompanying drawings. In describing the embodiments, same parts will be given the same names and reference numerals, and repetitive description of which will be omitted. For reference, parts of the compressor will be given the same reference numerals with ones described with reference to FIGS. 1 to 3.

Figure 4:
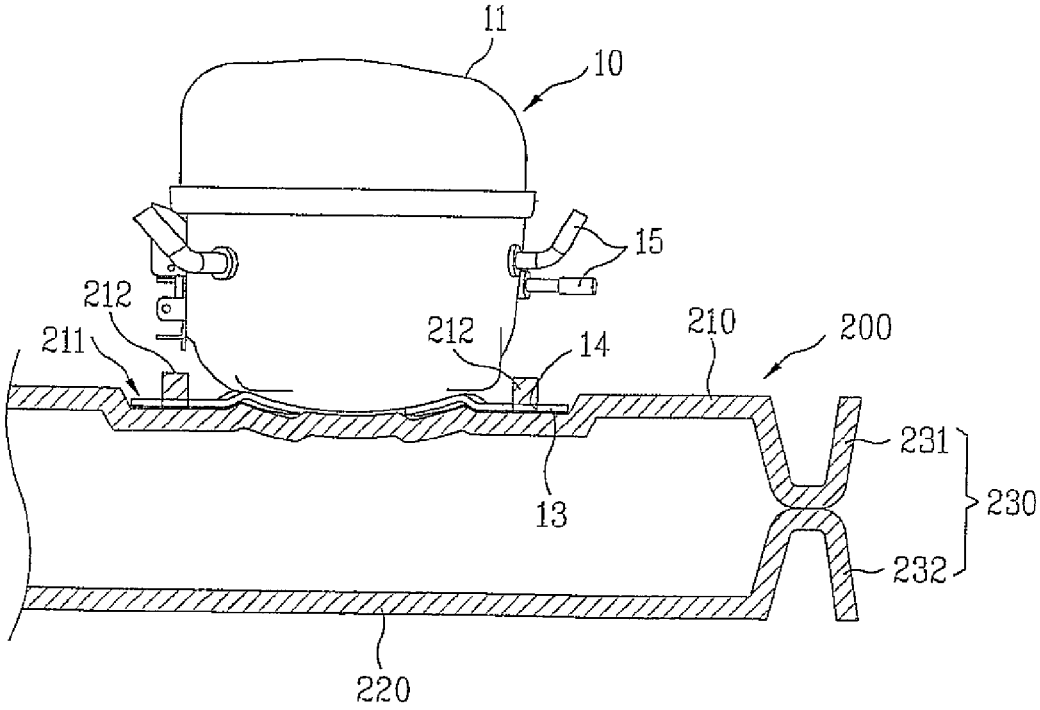
FIG. 4 illustrates a partial section showing that a compressor is fixed to a pallet in accordance with a preferred embodiment of the present invention.
Figure 5:
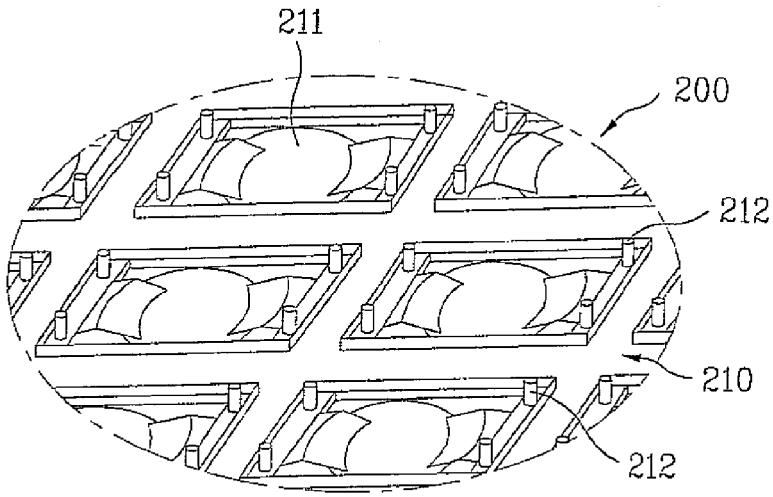
FIG. 5 illustrates a partial perspective view showing an upper part of a pallet according to an embodiment of the invention.
Figure 6:
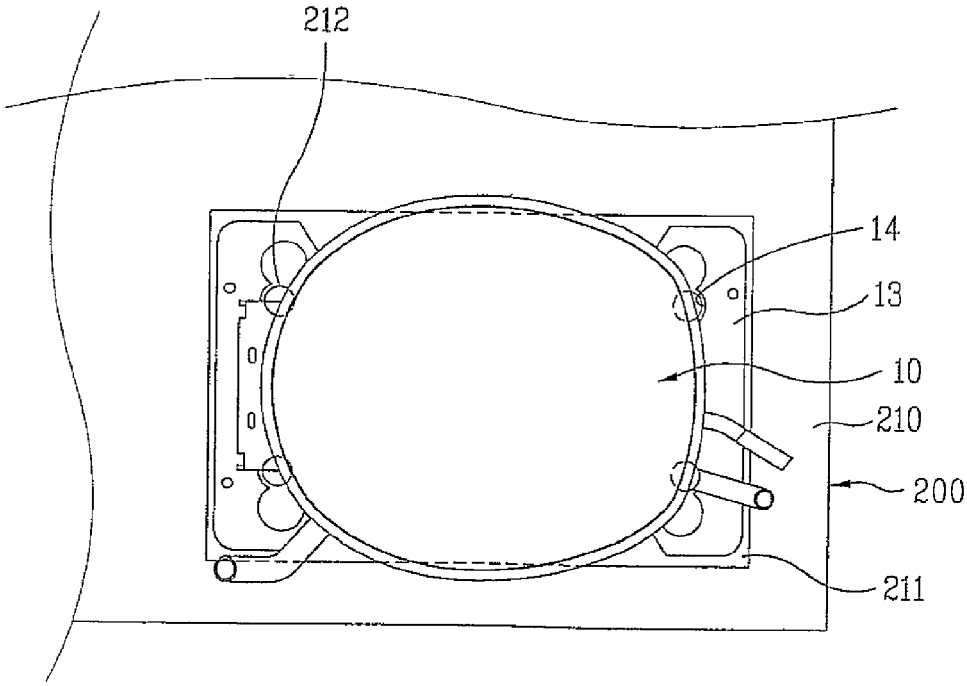
FIG. 6 illustrates a plan view showing a compressor fixed to the pallet in FIG. 4.

A compressor packing member of the present invention includes a pallet for supporting the compressors loaded at the first time from underside of the compressor, and pads each inserted between adjacent tiers of compressors for protecting the compressors. FIGS. 4 to 6 illustrate pallets 200 of the present invention, respectively. A structure of the pallet 200 will be described, at first.

Different from the related art pallet of wood, the pallet 200 of the present invention is formed of plastic, fabricated as one unit including an upper plate 210, and a lower plate 220, respectively. The upper plate 210 and the lower plate 220 are arranged in an up/down direction with a gap therebetween and a connection part 230 supports the gap.

The connection part 230 may be formed separate from the upper plate 210 and the lower plate 220, and connected to the upper plate 210 and the lower plate 220. However, for this, it is required to form the three components separately, and bond the three together, which is not convenient.

Therefore, the present invention suggests forming at least a part of the connection part as one unit with at least one of the upper plate 210 and the lower plate 220. For an example, as shown in FIG. 4, the connection part 230 may include an upper part 231 extended downward from the upper plate 210, and a lower part extended upward from the lower plate 220.

In this case, once the upper part 231 and the lower part 232 are bonded together, the upper plate 210 and the lower plate 220 are supported, with a gap therebetween. Moreover, what is required for fabricating the pallet 200 is formation, and bonding of two parts, which is very convenient for mass production.

However, a structure of the connection part 230 is not limited to above structure, only. For an example, the connection part 230 may be extended downward from the upper plate 210 extensively, and bonded to the lower plate 220. Moreover, the connection part 230 may be extended upward from the lower plate 220 extensively, and bonded to the upper plate 210. Therefore, at least a part of the connection part 230 is extended from the upper plate 210 or the lower plate 220 extensively, and bonded to either one of the upper plate 210 or the lower plate 220.

Positions and a number of the connection parts 230 are determined, taking weight and a number of the compressors 10 to be loaded on the upper plate 210 into account. Of course, as shown in FIG. 4, a shape of the connection part 230 may vary, as far as the connection part 230 connects, and maintains a distance between, the upper plate 210 and the lower plate 220.

In the meantime, the upper plate 210 has the plurality of compressors 10 loaded in rows and columns thereon. For this, the upper plate 210 has supporting surfaces 211 on an upper surface thereof each for supporting a bottom of the compressor 10. The supporting surface 211 is recessed in the upper surface of the upper plate 210.

Different from the related art, in the pallet of the present invention, the supporting surface 211 supports the bottom of the compressor 10 such that a load of the compressor 10 can be spread. For this, the supporting surface 211 has an upper surface fit both to a mounting plate 13 attached to the bottom of the compressor 10, and an underside surface of the lower case 12, which will be described in more detail.

An underside surface of the compressor 10, i.e., the underside surface of the lower case 12 is substantially spherical. The lower case 12 has at least two mounting plates 13 attached to a lower part thereof with welding, or the like, to form steps between the mounting plate 13 and a central part of the underside surface of the lower case 12.

According to this, in the pallet 200 of the present invention, a part of the supporting surface 211 is formed to support the mounting plates 13, and rest part of the supporting surface 211 is formed to project higher than the part that supports the mounting plates 13, and support the lower case 12, directly.

In the meantime, it is required that the compressor 10 loaded on the supporting surface 211 with such a structure is not movable by an external impact or an inertia force during transportation. For this, the upper plate 210 has pins 212 projected therefrom for holding the mounting plate 13 of the compressor 10. As shown in FIGS. 4 and 5, the pin 212 is projected, for an example, upward from the supporting surface 211, for inserting into the holes 14 provided to the mounting plate 13 when the compressor 10 is loaded on the supporting surface 211.

The pins 212 are formed as one unit with the upper plate 210 when the upper plate 210 is formed. As shown in FIG. 5, the pins may be four for one supporting surface 211, for secure holding of the compressor 10.

However, the pins 212 are not necessarily four for one supporting surface 211. For an example, of the four pins 212, only two pins 212 opposite in a diagonal direction may be provided. In this case too, since left/right movement of the compressor 10 loaded on the supporting plate 211 can be prevented, the compressor 10 can be loaded comparatively securely.

As another example, of the four pins 212, only adjacent two pins 212 may be provided, when, though one side of the compressor 10 may move in an up/down directions, at least large scale left/right movement of the compressor 10 can be prevented.

Figure 7:
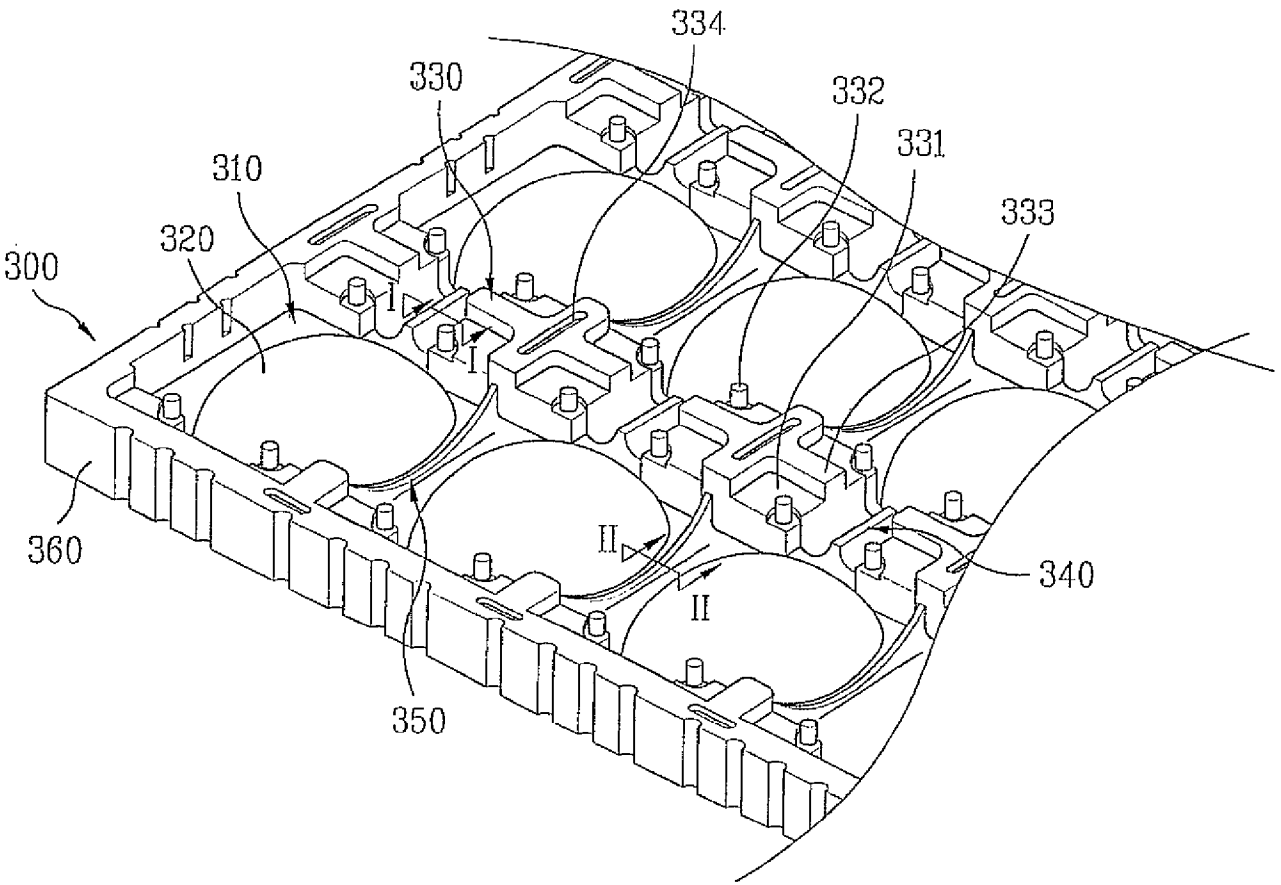
FIG. 7 illustrates a partial perspective view showing a pad in accordance with a preferred embodiment of the present invention.

Referring to FIG. 7, since the compressors 10 are loaded on a pad 300 placed on the compressors 10 loaded on the pallet 200, an up/down movement of the compressors 10 can be prevented.

Therefore, it is adequate that at least two pins 212 are provided to each of the supporting surfaces 211 for preventing the compressor 10 from moving in left/right directions. However, in a case only the adjacent two pins 212 are provided, the mounting plate 13 on a side no pins 212 are provided thereon is movable slightly. Therefore, for more secure mounting of the compressor 10, it is preferable that the pins 212 are formed at least on opposite diagonal positions.

In the meantime, it is required that the pallet 200 has a structure that can be lifted with a forklift, and the like with easy. For this, it is required that the pallet 200 has spaces in both side parts thereof for inserting forks of the forklift. Meanwhile, the upper plate 210 and the lower plate 220 of the pallet 200 are spaced a distance. Therefore, it will be adequate if a part, or all of sides of the pallet 200 is opened for insertion of the forks.

The pallet 200 forms a lowest tier of multiple tiers of compressors 10 bound or packed into one packed body, and supports the lowest tier of the compressors 10.

Since the supporting surface 211 supports the lower part of the compressor 10, the load of the compressor 10 can be spread. According to this, application of a strong bending moment to the pin 212 inserted into the mounting plate 13 of the compressor 10 can be prevented, thereby preventing an easy breakage of the pin 212.

Moreover, since the upper plate 210 is formed as one unit with the pins 212, an easy break away of the pin 212 from the supporting surface 211 can be prevented. Since the pallet 200 is formed of, not wood, but plastic, the pallet 200 is reusable.

In the meantime, referring to FIG. 6, once the compressors 10 are loaded on the supporting surfaces 211 on the upper surface of the pallet 200 respectively, as shown in FIG. 7, the pad 300 of the present invention is placed the compressors 10. Then, a plurality of compressors 10 are loaded on the pad 300. The pad 300 will be described with reference to FIGS. 7 to 8B.

The pad 300 of the present invention has a rectangular circumference 360 substantially when seen from above, and formed of plastic or corrugated board as one unit. Size and thickness of the pad 300 are designed to vary with size and a number of compressors 10 to be loaded on the pad 300.

The pad 300 has a plurality of platforms 330 in rows and columns, with the hollow loading lots 310 provided between the platforms 330. In more detail, as shown in FIG. 7, the loading lot 310 is arranged among adjacent four platforms 330, and the compressor 10 is loaded in the loading lot 310. Corners of the mounting plates 13 of the compressor 10 loaded on the pad 300 are supported on the four adjacent platforms 330.

The loading lot 310 has a dome 320 projected upward from a bottom surface of the loading lot 310, for preventing direct contact of a top part of an underlying compressor 10 loaded under the pad 300 with an underside surface of the loading lot 310. Therefore, it is preferable that the dome 320 has a shape similar to the upper case 11 of the compressor 10.

It is desirable that the top of the dome 320 has a height that can support the lower part of the compressor 10, slightly. Then, even if the dome 320 can not support the lower case 12 of the compressor 10 fully due to a nature of a shape of the dome 320, the dome 320 can support the lower case 12 partly, to spread the load of the compressor 10 applied to the pad 300.

In the meantime, as can be noted in FIG. 7, in the pad 300 of the present invention, the platforms 330 compartmentalizes the loading lots 310 in a column direction while supporting the mounting plates 13 of the compressor 10. The platforms 330 are formed, not continuous in a column direction, but independent from each other.

The independent formation of a plurality of platforms 330 along a column direction, not only provides a larger surface area of the pad 300, but also has the platforms 330 projected at regular intervals to serve as reinforcing members. According to this, strength of the pad 300 is improved, and drooping of both sides of the platforms 330 in a row direction can be prevented when the compressors 10 are loaded on the loading lots 310.

In the meantime, the platform 330 has supporting surfaces 331 for supporting corners of the mounting plates 13, and pins 332 for inserting in the holes 14 in the mounting plate 13. The supporting surface 331 is projected to a height from a bottom surface of the loading lot 310, and the pin 332 is projected from the supporting surface 331.

The supporting surface 331 and the pin 332 are provided to each corner of the platform 330. In more detail, as shown in FIG. 7, in a case of the platform 330 on an inner side of the circumference 360 of the pad 300, the supporting surface 331 and the pin 332 are provided to each of four corners of the platform 330. In a case of the platform 330 connected to the circumference 360 of the pad 300, the supporting surface 331 and the pin 332 are provided to each of two corners of the platform 330. Lastly, in a case of the platform 330 provided to an inner side of the corner of the pad 300, the supporting surface 331 and the pin 332 are provided to one corner of the platform 330.

However, the pins 332 are thus provided not necessarily to all corners of the platform 330. The pins 332 may be provided to two corners of the platform 330 opposite in a diagonal direction with die loading lot 310 in between under a reason similar to a reason described in a case of the pins 212 of the pallet 200.

In the pad 300 of the present invention, the platform 330 has a rib 333 for reinforcing strength of the platform 330, additionally. The rib 333 projects from an upper surface of the platform 330 in a shape of a cross. FIG. 7 illustrates an example of a cross shaped rib 333 projected from a central part of an upper part of each of the platforms 330.

The provision of the rib 333 in the upper part of the platform 330 can prevent drooping of both sides of the platform 330 in the row direction or column direction compared to a central part of the platform 330 effectively when the compressors 10 are loaded on the loading lots 310.

However, the rib 333 is not necessarily provided in the crossed shape. That is, taking weight of the compressor 10 loaded on the loading lot 310, and strength, and material of the pad 300 into account, the rib 333 may even be formed only in the row direction or column direction. Of course, the rib 333 may cross the upper surface of the platform 330 in a diagonal direction.

A reinforcing groove 334 may be provided for reinforcing strength of the platform 330, additionally. The reinforcing groove 334 extends in the row or column direction in a central part of the upper surface of the platform 330, or, when the rib 333 is provided, in the upper surface of the rib 333.

For reference, FIG. 7 illustrates an embodiment in which the reinforcing groove 334 extends in a row or column direction in the upper surface of each of the platforms 330 in the case of the platforms 330 connected to the circumference 360, and the reinforcing groove 334 extends in the row direction in the upper surface of the rib 333 of each of the platforms 330 in the case of platforms 330 on an inner side of the circumference 360.

In the meantime, the pad 300 of the present invention further includes a reinforcing ridge 340 for effective prevention of drooping of both sides of the platform 330 in the row direction. As shown in FIG. 7, the reinforcing ridge 340 projects between the platforms 330 adjacent in the column direction.

Figure 8A:
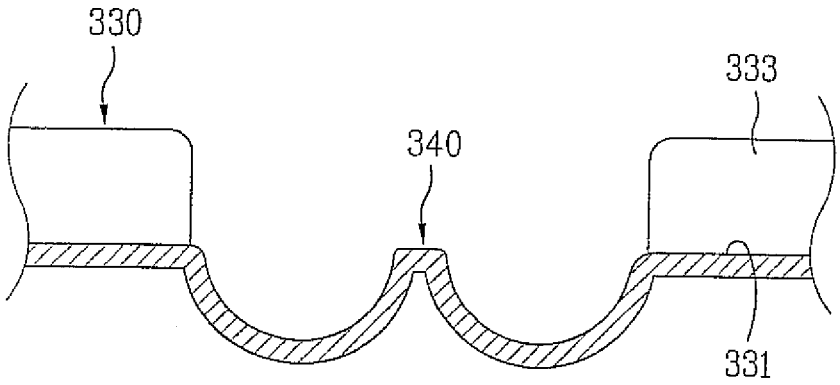
FIG. 8A illustrates a section across a line I-I in FIG. 7.

In this instance, it is preferable that the reinforcing ridge 340 extends in the row direction, preferably with one side surface of the reinforcing ridge 340 and one side surface of the platform 330 connected with a concave surface as shown in FIG. 8A.

Above structure, not only provides a larger area between the platforms 330, to reinforce strength, but also enables to sustain a row direction force pressing opposite sides of the platform 330 more effectively owing to the reinforcing ridge 340 provided in the row direction and the concave surface.

Each of the reinforcing ridge 340 and the concave surface extends to a length the same with a row direction length of the platform 330. It is required that the reinforcing ridge 340 has a height lower than the supporting surface 331 of the platform 330. Otherwise, an upper part of the reinforcing ridge 340 interferes with the mounting plates 13, to fail the mounting plates 13 supported on the supporting surface 331.

Figure 8B:
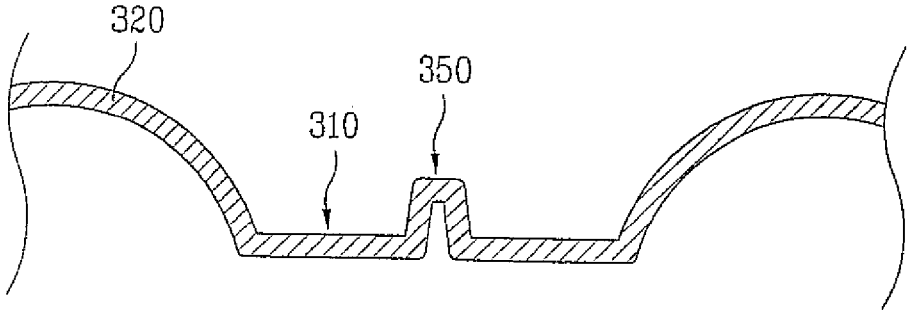
FIG. 8B illustrates a section across a line II-II in FIG. 7.

In the meantime, referring to FIGS. 7 and 8B, a partition wall 350 is provided between adjacent column direction loading lots 310 for separating the adjacent loading lots 310. The partition wall 350 projects upward between adjacent loading lots 310 such that two platforms 330 adjacent in the row direction are connected therewith. An upper surface of the projected partition wall 350 has opposite edges connected to the platforms 330 respectively formed higher than a center part.

The provision of the partition walls 350 between adjacent loading lots 310 aligned in a longitudinal direction provides a greater resisting force against a force applied to the loading lots 310, to enhance strength of the pad 300.

In the meantime, as described, it is preferable that the circumference 360, provided to connect an outermost platform 330 and the loading lot 310, has a height the same with an upper surface of the platform 330.

The foregoing pad 300 is placed on the compressors 10 on the pallet 200, and the loading lots 310 of the pad 300 have the compressors 10 loaded thereon, respectively. In this instance, since the pins 332 are inserted in the holes 14, the compressor 10 is unable to move in left/right directions, but fixed.

When mounting of all the compressors 10 on the loading lots 310 of the pad 300 are fished, a new pad 300 is placed on the compressors 10, and new compressors 10 are loaded thereon again. By this method, the compressors 10 and the pads 300 are stacked alternately in many tiers. Then, the pad 300 is placed on top of the compressors 10 at the uppermost tier again, or a finishing member of Styrofoam fabricated to protect upper parts of the compressors is placed on the top of the compressors 10 at the uppermost tier. After all the compressors 10 and the pads 300 are stacked, the stack is bound or packed to form one whole unit of packed body.

The one packed body fabricated thus can be carried with forklift or the like with easy. Moreover, after another packed body can be stacked on the packed body laid on ground, another packed body can be stacked thereon. That is, since the packed bodies can be stacked in many tiers, many packed bodies can be stored even within a small space, effectively.

The packed bodies can be stored in many tiers thus because the pads 300 hardly deform in the row direction or the column direction even if the compressors 10 are stacked owing to the high strength of the pads 300.

That is, since the reinforcing ridges 340, the ribs 333, the reinforcing grooves 334, the partition walls 350, and the like enhance strength of the pad 300, the pad 300 can sustain a leveled state even if the compressors 10 are loaded thereon, to enable an upper surface of the packed body to maintain a leveled state, permitting to store many packed bodies in many tiers.

As has been described, the present invention has the following advantages.

First, in the pallet of the present invention, the pin is formed as one unit with the upper plate, and no bending moment is applied to the pin because the supporting surface in the upper surface of the pallet supports the lower part of the compressor, to spread a load of the compressor. Therefore, strength of the pin can be increased, and an external force applied to the pin can be reduced. According to this, breakage of the pin can be prevented, and damage to the compressor during transportation can be prevented.

Second, at least the upper plate of the pallet is formed of plastic as one unit, permitting easy fabrication, and recycling after use for a long time.

Third, the reinforcing ridges between platforms that align the loading lots in the column direction, and the reinforcing ribs and the reinforcing grooves to the platforms increase an overall strength of the pad, to prevent deformation of the pad even if a plurality of compressors are loaded on the pad, permitting to stack the compressors in many tiers.

The high strength of the pads enables to sustain a level of an upper surface of the packed body bound or packed after stacked in many tiers, permitting to stack the packed bodies in many tiers, to store many compressors within a small space. Moreover, the secure stacking of the packed bodies can prevent accidents caused by negligence of safety.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A packing assembly for a plurality of compressors, the packing assembly comprising:

a pallet for packing a plurality of compressors, each of the plurality of compressors including a mounting plate attached to an underside surface of the respective compressor, the pallet comprising:

an upper plate having a plurality of supporting surfaces, each of the supporting surfaces comprising:

an upper surface that supports a lower surface of the mounting plate and at least a portion of the underside surface of a respective compressor of the plurality of compressors, the supporting surface being complementary in shape to the mounting plate and the at least a portion of the underside surface of the respective compressor of the plurality of compressors;

a plurality of pins that project upward from the respective supporting surface, the plurality of pins being spaced a predetermined distance from outer edges of the respective supporting surface and configured to be inserted into holes of the mounting plate of the respective compressor of the plurality of compressors when the respective compressor rests on the supporting surface; and at least one recess in the upper surface;

a lower plate arranged under, and spaced from the upper plate; and a connection part including an upper part that extends downward from the upper plate having a sectional shape of "U", and a lower part that extends upward from the lower plate having a sectional shape of "∩", wherein the upper plate and the lower plate are supported with a gap therebetween, wherein a lower end of the upper part having a sectional shape of "U" and an upper end of the lower part having a sectional shape of "∩" are bonded together, wherein a part, or all of sides of the pallet is open for insertion of forks of a forklift by exposing outwardly the gap between the upper plate and the lower plate, and wherein the pallet forms a lowest tier of multiple tiers of compressors packed into one packed body, and supports the lowest tier of the compressors; and a plurality of pads, each being configured to be placed on an upper side of each tier of the multiple tiers of compressors, wherein the plurality of pads forms other tiers of multiple tiers of compressors packed into the one packed body.

2. The packing assembly as claimed in claim 1, wherein the upper plate is formed as one unit.

3. The packing assembly as claimed in claim 1, wherein the supporting surfaces are arranged in a plurality of rows and columns on an upper surface of the upper plate.

4. The packing assembly as claimed in claim 1, wherein each of the supporting surfaces includes at least two pins.

5. The packing assembly as claimed in claim 1, wherein the upper plate is formed of plastic.

* * * * *